United States Patent [19]

Delet

[11] 4,418,696

[45] Dec. 6, 1983

[54] SUPPORT BRASSIERE

[76] Inventor: Victoria Delet, 60 West 57 St., New York, N.Y. 10019

[21] Appl. No.: 324,157

[22] Filed: Nov. 23, 1981

Related U.S. Application Data

[63] Continuation of Ser. No. 67,514, Aug. 17, 1979.

[51] Int. Cl.[3] ..... A41C 1/14

[52] U.S. Cl. ..... 128/476

[58] Field of Search ..... 128/465, 473, 510, 425, 128/483, 476, 469, 477

[56] References Cited

U.S. PATENT DOCUMENTS

| | | |
|---|---|---|
| 858,867 | 7/1907 | Gaylord . |
| 2,440,426 | 4/1948 | Barlow et al. . |
| 2,440,922 | 5/1948 | Algon . |
| 2,482,953 | 9/1949 | Waters . |
| 2,864,375 | 12/1958 | Steinmetz . |
| 3,109,431 | 11/1963 | Jefferson . |
| 3,216,425 | 11/1965 | De Keersmaecker . |
| 3,396,728 | 8/1968 | Sachs et al. . |
| 3,411,508 | 11/1968 | Sayers . |
| 3,605,753 | 9/1971 | Schwartz . |
| 3,763,865 | 10/1973 | DeFru . |
| 3,998,231 | 12/1976 | Delet . |

FOREIGN PATENT DOCUMENTS

| | | |
|---|---|---|
| 548177 | 3/1922 | France . |
| 1043400 | 10/1951 | France . |
| 1086195 | 11/1953 | France . |
| 1380788 | 11/1963 | France . |
| 1416514 | 9/1964 | France . |

*Primary Examiner*—Doris L. Troutman

*Attorney, Agent, or Firm*—Amster, Rothstein & Engelberg

[57] ABSTRACT

A backless brassiere incorporates a pair of semi-rigid support members secured along the inner and lower portion of each cup and extending to a position under the wearer's arm. The structure further includes a pair of side panels extending outwardly from the outer edges of the bust cups to the semi-rigid support members. The side panels and semi-rigid supports, together, provide upward and lateral support for the bust.

1 Claim, 4 Drawing Figures

SUPPORT BRASSIERE

This is a continuation of application Ser. No. 067,514, filed Aug. 17, 1979.

This invention relates generally to brassiers and more specifically to a new brassiere construction designed to provide substantial support without discomfort.

Numerous brassiere constructions have been designed in an attempt to provide a wearer with good support and attractive appearance without the need for complicated and cumbersome panel arrangements running across the wearer's back. Panels across the wearer's back, with corresponding shoulder straps, simplify the mechanical problem of adequately supporting the bust. However, such cumbersome arrangements are normally unattractive since they are frequently visible beneath the wearer's clothing and cannot be used at all with backless fashions.

Another problem with support bras having substantial back panel and strap arrangements is wearer discomfort. Such arrangements not only bind the wearer and are themselves uncomfortable, but can cause circulatory problems and muscle strains. Further, back panels and straps distort the natural appearance and movement of the bust in relation to the body.

One backless brassiere arrangement which sought to overcome these problems is described in applicant's U.S. Pat. No. 3,998,231. This arrangement incorporates a U-shaped underwire secured along the lower portion of each bust cup and an arcuate extension extending outwardly from the lower portion thereof to a position where it engages a strap arrangement. While this design was a substantial improvement over prior arrangements known at that time, applicant has unexpectedly found that good support and substantially simplified construction can be achieved by a new construction which incorporates a single semi-rigid support member secured along the inner and lower portion of each cup which extends outwardly from the lower portion of the cup. This, in combination with an appropriately adjusted side panel provides both vertical and lateral support for the bust. The quality of support provided by the present arrangement was entirely unexpected in view of the absence of lateral support for the bust by any portion of the semi-rigid member. In addition, it has been found that the present arrangement is more comfortable for some wearers.

Accordingly, it is an object of the present invention to provide a brassiere construction having improved support without cumbersome strap arrangements that is relatively simple to manufacture and provides a natural appearance for the bust. A further object of the present invention is to provide a brassiere construction which gives good vertical and lateral support to the bust and which can be used in conjunction with backless fashions.

In accomplishing these and other objects in accordance with the present invention, a brassiere is constructed with a pair of bust cups secured together along their inner edge and having a pair of side panels secured at their outer edge and extending outwardly from the bust cups. A semi-rigid support member is secured along the inner and lower portion of each cup and extends outwardly from each cup in an arc to a position under the wearer's arm. Straps are connected between the outward portion of the semi-rigid member, extended over the wearer's shoulder and to the upper portion of the bust cups.

Further objects, features and advantages of the present invention will be more fully appreciated by reference to the following detailed description of a presently preferred embodiment of the present invention when taken in conjunction with the appended drawings wherein.

Figure 1:
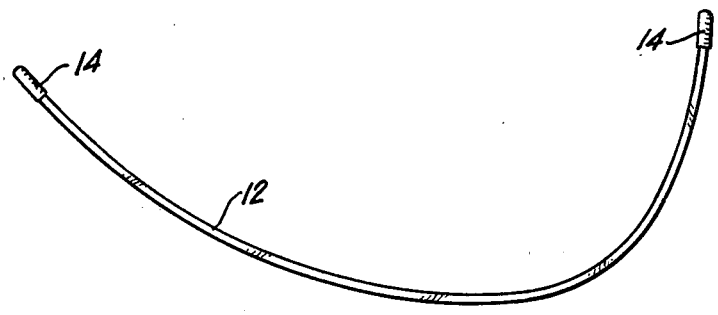
FIG. 1 shows a semi-rigid support member in accordance with the present invention.

Referring to the drawings, FIG. 1 shows a preferred form of the support member 12 used in the present invention. The support member is preferably manufactured of a relatively thin spring metal, although it should be understood that any material such as plastic or the like, having adequate rigidity and spring, may be used. If member 12 is metal, it is desirable to have rubber or plastic end caps 14 on the free ends of the member so as to prevent injury from sharp metal edges.

The semi-rigid support member of FIG. 1 is asymmetrical, having a steep upwardly curved portion (on the right side of FIG. 1) adapted to be positioned adjacent the inner edge of the bust cup, and a more gradually arced portion designed (left side in FIG. 1) adapted to extend outwardly under the wearer's arm. This extending portion does not conform to the outer contour of the breast but is designed to extend outwardly from the lower portion of the breast beneath the wearer's arm for support. It will be understood that when incorporated into the brassiere in accordance with applicant's invention the outwardly extending portion conforms to the side of the wearer's body extending rearwardly around the wearer's rib cage.

Figure 2:
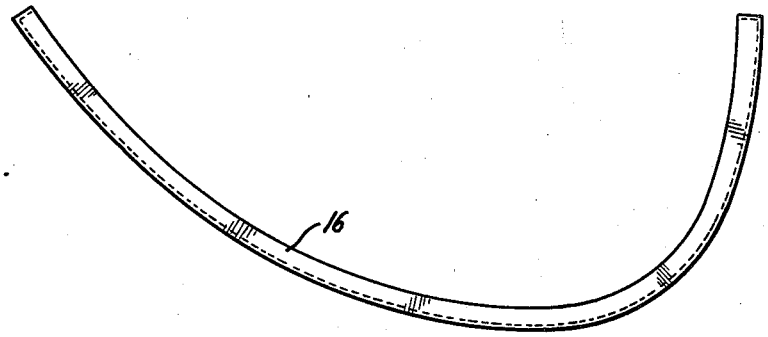
FIG. 2 shows a fabric sheath containing the semi-rigid support member.

FIG. 2 shows a fabric sheath 16 for receiving the semi-rigid support member 12. The sheath is preferably a piece of elongate fabric which is folded and stitched around member 12 to both cushion the engagement of the semi-rigid support with the body and to provide an encasement for the semi-rigid support which permits it to be more easily attached to the garment.

Figure 3:
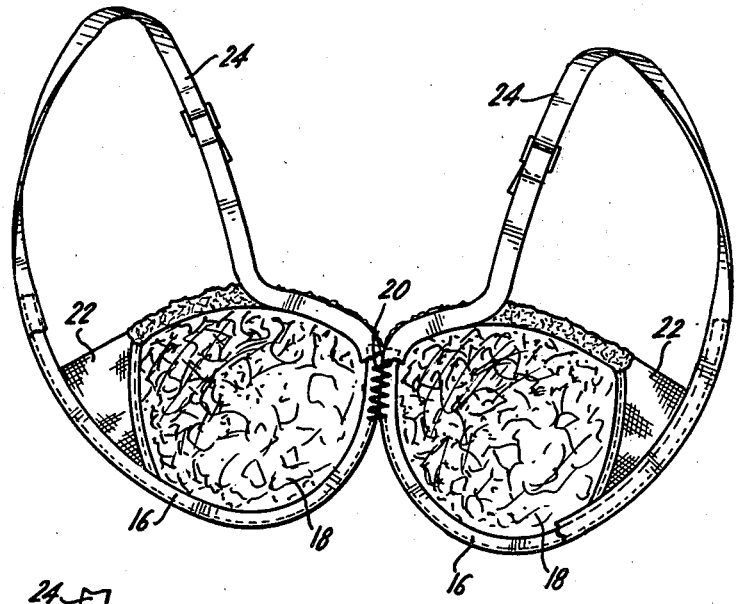
FIG. 3 is an interior view, partially broken away, of a first embodiment of the brassiere in accordance with the present invention.

FIG. 3 is an inner view of a first embodiment of a brassiere in accordance with the present invention. The brassiere includes a pair of bust cups 18 secured together along their inner edge by stitches 20. As will be apparent hereafter, numerous other arrangements are available for securing the inner edge of the bust cups to one another.

Each bust cup 18 has associated with it a semi-rigid support member 12 in its sheath 16. These semi-rigid supports 12 are secured to the cup so that they extend along the inner edge of the cup around the lower edge of the cup and extend outwardly from the lower portion of the cup in an outwardly extending direction.

A pair of side panels 22 are secured adjacent to the outer edge of each bust cup 18 and extend from said outer edge to the extending portion of the semi-rigid member 12. In the embodiment shown in FIG. 3, the side panels 22 are stitched to the outer edge of the bust cup 18 and are stitched to the sheath 16 carrying the semi-rigid support member.

Each bust cup is provided with a strap 24 which, in the embodiment of FIG. 3, overlays the semi-rigid support member and extends along the semi-rigid support member beyond the outer edge thereof and over the wearer's shoulder to a position at the top of each cup. In the embodiment of FIG. 3 the strap also runs along the inner section of the cup, downwardly along the inner edge of the cup and along the lower edge of the cup, overlaying the semi-rigid support member. The use of two independent strap loops, one associated with each cup permits more independent support of the two lateral sides of the body. It will be understood that the strap arrangement shown in FIG. 3 is merely a presently preferred construction and numerous other strap arrangements may be employed in conjunction with the present invention.

Figure 4:
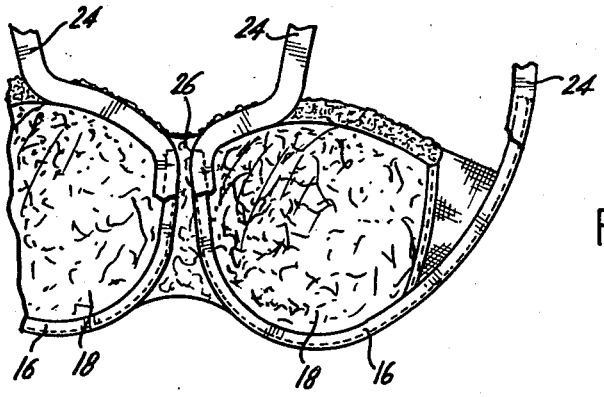
FIG. 4 is a partial interior view, partially broken away showing a second embodiment of the brassiere in accordance with the present invention.

FIG. 4 shows a second embodiment of the present invention wherein a center panel 26 is incorporated between the bust cups 18. Panel 26 is secured to the bust cups along their inner edges.

Applicant's brassiere construction avoids cumbersome back panels and straps which support the breast by pulling from support points at the top and side of the cup. Applicant's construction provides substantial support for the breast from beneath, creating a more comfortable feel and more natural appearance and permitting more natural movement of the breast.

What I claim is:

1. A brassiere comprising a pair of bust cups, said bust cups being secured together adjacent to the inner edge, a semi-rigid support member secured along the inner and lower portions of each of said bust cups and extending outwardly from the lower portion of each bust cup to a position beneath the wearer's arm, strap means extending at least from a position adjacent to the outer edge of said semi-rigid support member to a position on the upper portion of one of said bust cups forming a loop extending over the wearer's shoulder, and a flexible side panel secured at the outer edge of each of said bust cups and extending outwardly therefrom to engage the outwardly extending portion of said support member for retaining the outer edge of the cup against the wearer's body.

* * * * *